US005180954A

United States Patent [19]

Wakana et al.

[11] Patent Number: 5,180,954

[45] Date of Patent: Jan. 19, 1993

[54] METHOD AND APPARATUS FOR CONTROLLING A SEWING MACHINE

[75] Inventors: Takayuki Wakana; Satomi Yamauchi, both of Aichi, Japan

[73] Assignee: Mitsubishi Denki K.K., Tokyo, Japan

[21] Appl. No.: 637,584

[22] Filed: Jan. 4, 1991

[30] Foreign Application Priority Data

Jan. 8, 1990 [JP] Japan ..... 2-1178

[51] Int. Cl.[5] ..... H02P 5/00

[52] U.S. Cl. ..... 318/369; 318/269

[58] Field of Search ..... 318/254, 132, 139, 439, 318/434, 269, 268, 273, 367, 369, 783, 779; 361/23, 28, 29, 30, 31, 51; 66/161, 163; 388/800, 842, 803, 809, 824, 903, 904

[56] References Cited

U.S. PATENT DOCUMENTS 3,573,581 4/1971 Dutko et al. ..... 318/466 X
3,715,642 2/1973 Walter ..... 318/269
3,959,704 5/1976 McCrea ..... 318/434
4,028,593 6/1977 Newell ..... 361/27
4,509,088 4/1985 Profio ..... 361/29
4,642,536 2/1987 Boyd, Jr. et al. ..... 318/254
4,691,653 9/1987 Neki et al. ..... 318/369 X
4,692,676 9/1987 Dohi et al. ..... 318/254 X
4,738,211 4/1988 Nakamura et al. .

FOREIGN PATENT DOCUMENTS 61-257686 11/1986 Japan .
63257689 11/1986 Japan .
63-272397 11/1988 Japan .

*Primary Examiner*—A. Jonathan Wysocki
*Attorney, Agent, or Firm*—Sughrue, Mion, Zinn, Macpeak & Seas

[57] ABSTRACT

A sewing control system for controlling the speed of rotation of a sewing machine in which in a first embodiment, a rotation transfer ratio operation is inhibited during the time that slip occurs. According to a second embodiment, the rotation transfer operation is initiated only when the number of revolutions of the motor shaft is higher than a predetermined value. In a third embodiment, slip is prevented by not outputting a speed instruction which is not steeper than a predetermined gradient. In a fourth embodiment, when an abnormal condition is detected, the rotation transfer ratio is reduced in order to reduce the speed of the motor, thereby assuring the safety of an operator.

16 Claims, 9 Drawing Sheets

METHOD AND APPARATUS FOR CONTROLLING A SEWING MACHINE

BACKGROUND OF THE INVENTION

This invention relates to a sewing machine control apparatus which controls the speed of rotation of a sewing machine to a predetermined value.

FIGS. 8 through 11 are diagrams for a description of one example of a conventional sewing machine which has been disclosed for instance by Published Unexamined Japanese Patent Application (OPI) No's 257686/1983 or 257689/1983 FIG. 8 shows the sewing machine. In FIG. 8, reference numeral 1 designates a sewing machine body which is coupled to an electric motor 2 through a sewing machine body's pulley 3, an endless belt 4 and a motor's pulley 5; 6, a control device; 7, a pedal with which the operator applies instructions such as for instance a speed instruction to the control device 6; 8, a needle position detector for detecting the position of the needle connected to the sewing machine body; and 9, an encoder built in the motor 2, for detecting the speed of rotation of the motor shaft.

FIG. 9 is a block diagram showing the arrangement of the control system shown in FIG. 8. In FIG. 9, reference numeral 1, designates the aforementioned sewing machine body; 2, the electric motor; 4, the endless belt; 8, the needle position detector; 9, the encoder; 10, a speed (number-of-revolution) setting unit which, when the pedal 7 is depressed a predetermined distance or more, outputs a start instruction signal $S_D$ and a speed instruction signal $P_S$ corresponding to the amount of depression of the pedal 7; 11, a multiplier; 12, a speed control circuit; 13, a counter for counting the output signal $P_E$ of the encoder 9; 14, a latch circuit; and 15, an arithmetic circuit.

FIG. 10 is a block diagram showing the arithmetic circuit 15 in detail. In FIG. 10, reference numeral 16 designates a central processing circuit (hereinafter referred to as "a CPU 16", when applicable). The CPU 16, in synchronization with a clock signal from an oscillator circuit 17, receives data through an input port 18, applies data to an output port 19, makes access to a RAM 20, and reads data from a ROM 21.

Further in FIG. 10, reference numeral 22 designates a reset circuit. When a voltage for operating the arithmetic circuit 15 is stabilized after the power switch is turned on, the output of the reset circuit 22 is raised to "H" level from "L" level to allow the CPU 16 to start its operation.

FIG. 11 is a flow chart for a description of the rotation transfer ratio operation of the arithmetic circuit 15. In Steps 23, 24 and 25, initial setting operations are carried out. In Step 26, it is determined whether or not the rotation transfer ratio operation is accomplished. In Step 27, the start instruction signal $S_D$ is inputted. In Step 28, it is determined whether the start instruction signal $S_D$ is at "H" level. In step 29, an interrupt is disabled when a needle position detection signal $N_D$ (the part (b) of FIG. 11) is detected. In step 30, the interrupt is enabled. In Step 31, it is determined whether or not the rotation transfer ratio operation is accomplished. In Step 32, it is determined whether or not the rotation transfer ratio operation should be performed. In Step 33, the rotation transfer ratio operation is permitted. In Steps 34 through 38, the rotation transfer ratio operation is carried out.

The operation of the sewing machine control device thus constructed will be described.

When the pedal 7 is depressed the predetermined distance or more, the speed setting unit 10 outputs the start instruction signal $S_D$, which is applied to the speed control circuit 12 (FIG. 9). As a result, the speed control circuit 12 starts the electric motor 2, and simultaneously the latter 2 starts the sewing machine body 1 being coupled through the endless belt thereto. On the other hand, speed setting unit 10 provides a speed instruction signal $P_S$ in correspondence to the amount of depression of the pedal 7 which is applied to the multiplier 11. In the latter 11, the speed instruction signal is multiplied by the set value Dhd P provided by the arithmetic circuit 15, to provide a rotation setting instruction $P_M$, which is applied to the speed control circuit 12. The latter 12 performs a control operation so that the speed of the motor 2 which is obtained from the output signal $P_E$ of the encoder be equal to the speed instruction signal $P_M$. Thus, the motor 2 is so controlled that its speed is equal to the speed indicated by the speed setting instruction $P_M$.

When the pedal 7 is returned to the original position (hereinafter referred to as "a neutral position", when applicable), the speed setting unit 10 eliminates the start instruction signal $S_D$. The speed control circuit 12 sets a speed low enough to position the needle according to the speed instruction signal $P_S$, measures the output signal $P_E$ of the encoder 9 to detect the speed of the motor 1, and stops the motor 2 when, after the actual speed reaches the set speed or lower, the needle position signal $N_D$ is outputted. Thus, the sewing machine body 1 is stopped with the needle held at the predetermined position.

The counter 13 is reset when a needle position edge pulse signal $N_{DP}$ detecting the rise or fall of the needle position signal $N_D$ is set to "L" level from "H", and starts counting the output signal $P_E$ of the encoder 9. The latch circuit 14 latches the output data $D_C$ of the counter 13 when the needle position edge pulse signal $N_{DP}$ is set to "L" level from "H" level similarly as in the above-described case, and applies it to the arithmetic circuit 15.

In FIG. 11, under the initial condition revealed immediately after the reset signal is raised to "H" level from "L" level, a set value $D_{PI}$ is set. When, with the pedal 7 depressed, the start instruction signal $S_D$ is raised to "H" level from "L" level, an interrupt is enabled, and at the second switching of the needle position signal $N_D$ from "H" level to "L" level; that is, when the sewing machine body 1 has made one revolution, the output data $D_E$ of the latch circuit is obtained which is the total pulse number of the output signal $P_E$ of the encoder 9 indicating the angle of rotation of the motor 2 during one rotation of the sewing machine body 1. Thus, a transfer rotation ratio $D_P$ is obtained according to the following equation (1):

$$D_P = D_E / R \qquad (1)$$

where R is the pulse number of the output signal $P_E$ of the encoder 9 provided while the motor 2 makes one revolution.

That is, $D_P$ in equation (1) is the ratio of the angle of rotation of the motor shaft to the sewing machine spindle; that is, the ratio of the motor pulley diameter to the sewing machine body pulley diameter (hereinafter referred to as "a transfer rotation ratio", when applicable).

If the speed instruction value for the motor is represented by $N_{MT}$, then the following equation (2) is established:

$$N_{MT}=N_{SM}\times D_P \quad (2)$$

where $N_{SM}$ is the speed instruction value for the sewing machine body.

In equation (2), the speed instruction value $N_{MT}$ corresponds to the speed setting instruction $P_M$ in FIG. 9, and accordingly the speed instruction signal $P_S$ is the speed instruction value for the sewing machine body.

The flow chart of FIG. 11 will be described. When the power switch is turned on, in Steps 23, 24 and 25, the initial setting operations are carried out. Next, in step 27, the start instruction signal $S_D$ is received through the input port. In Step 28, it is determined whether the start instruction signal thus received is at "H" level or it is at "L" level. If it is at "L" level, in Step 29 the interrupt shown in the part (b) of FIG. 11 is disabled, and Step 26 is effected again. If in step 28, the start instruction signal $S_D$ is at "H" level, the interrupt (the part (b) of FIG. 11) is enabled, and Step 26 is effected again.

In Step 26, it is determined from a flag END whether or not the rotation transfer ratio operation has been accomplished. If it is accomplished, the following operation is carried out. If not accomplished, Step 27 is effected. When the rotation transfer ratio operation has been accomplished, the flag End is set in Step 35; and when it has not been accomplished, the flag end is maintained reset in step 23.

Now, the interrupt shown in the part (b) of FIG. 11 will be described. The interrupt is carried out when the needle position detection signal $N_D$ is detected. In Step 31, it is determined from the flag END whether or not the rotation transfer ratio operation has been accomplished. When it is determined that the rotation transfer ratio operation has been accomplished, no interrupt is carried out. If not, Step 32 is effected, so that it is determined from the flag FAST whether or not the rotation transfer ratio operation should be performed. The flag FAST is set in Step 33 at the first interrupt shown in the part (b) of FIG. 11. Hence, the rotation transfer ratio operation is performed when the needle position detection signal $N_d$ is detected twice.

In Steps 34, 35, and so on, the rotation transfer ratio operation is carried out. In Step 34, the total pulse number $D_E$ of the output signal $P_E$ of the encoder 9 is inputted through the input port. In Step 35, the flag END is set, and in Step 36, a rotation transfer ratio $D_2$ is operated. In Step 37, the rotation transfer ratio $D_{P2}$ is stored in a part of the RAM 20 such as a RAM1, and in Step 38 the rotation transfer ratio $D_{P2}$ is outputted. Thus, the interrupt has been accomplished.

In the above-described prior art, one needle position signal $N_D$ is produced every revolution. However, it should be noted that the above-described Published Unexamined Japanese Patent Application No. 257686/1986 has revealed that the rotation transfer ratio can be obtained by producing a plurality of needle position signals $N_D$ every rotation; that is, by producing them at equal angular intervals.

When the output signal of the encoder 9 is not detected for instance because of the breaking of wire, $D_P$ in equation (1) is zero, and the rotation transfer ratio operation is performed. Therefore, the sewing machine is operated with an incorrect rotation transfer ratio.

When an error occurs with the rotation transfer ratio operation as was described above, there has been provided no means of securing the operator nor means for informing the operator of the fact that the rotation transfer ratio operation is erroneous. Furthermore, in the prior art, the rotation transfer ratio operation is performed immediately after the needle position signal $N_D$ is received with the sewing machine body started. FIG. 12 is a graphical representation indicating the variation in the number of revolutions per minute (rpm) of the motor 2 being accelerated. At the start (F in FIG. 12) of the motor 2, slip is liable to occur with the sewing machine body pulley 3, the endless belt 4, and the motor pulley 5. Therefore, where, as shown in FIG. 13, the needle position signal $N_D$ is detected immediately after the start instruction signal $S_D$ is raised to "H" level from "L" level (or the distance G is short), the rotation transfer ratio operation is erroneous, being performed when the slip occurs in the above-described manner.

SUMMARY OF THE INVENTION

Accordingly, an object of this invention is to eliminate the above-described difficulties accompanying a conventional sewing machine control apparatus.

More specifically, an object of the invention is to provide a sewing machine control apparatus which, when the output signal of the motor speed detecting means cannot be detected for instance because of the breaking of wire, suspends the rotation transfer ratio operation.

Another object of the invention is to provide a sewing machine control apparatus with which, no error occurs with the rotation transfer ratio operation even when slip occurs with the rotation transmitting means.

A further object of the invention is to provide a sewing machine control apparatus which positively prevents the occurrence of slip.

A still further object of the invention is to provide a sewing machine control apparatus which, when an error occurs with the rotation transfer ratio operation, operates to decrease the speed for security of the operator.

A sewing machine control apparatus according to one aspect of the invention comprises means for controlling the start time of the arithmetic operation of arithmetic means adapted to operate a rotation transfer ratio.

A sewing machine control apparatus according to another aspect of the invention comprises means for making a rate of increase with time of a speed instruction for acceleration during rotation transfer ratio operation and rotation transfer ratio measurement smaller than that provided after the rotation transfer ratio operation.

A sewing machine control apparatus according to a further aspect of the invention comprises: means for making, when an error occurs with a rotation transfer ratio operation, the rotation transfer ratio smaller than that provided before the error has occurred with the rotation transfer ratio operation.

In the sewing machine control apparatus according to the invention, the means for controlling the start time of the arithmetic operation of the arithmetic means inhibits the arithmetic operation of the rotation transfer ratio when a slip or motor speed detecting means provides no output signal.

In the sewing machine control apparatus according to the invention the means for making a rate of increase with time of a speed instruction for acceleration before rotation transfer ratio operation and during rotation transfer ratio measurement smaller than that provided after the rotation transfer ratio operation operates as follows: When the gradient in change of the speed instruction is steep, the means makes it gentle so as to moderately accelerate the electric motor.

In the sewing machine control apparatus according to the invention, the means for making, when an error occurs with a rotation transfer ratio operation, the rotation transfer ratio smaller than that provided before the error has occurred with the rotation transfer ratio operation operates to decrease the speed of the motor when an error occurs with the rotation transfer ratio operation.

DESCRIPTION OF THE PREFERRED EMBODIMENTS

Preferred embodiments of this invention will be described with reference to the accompanying drawings.

Figure 1:
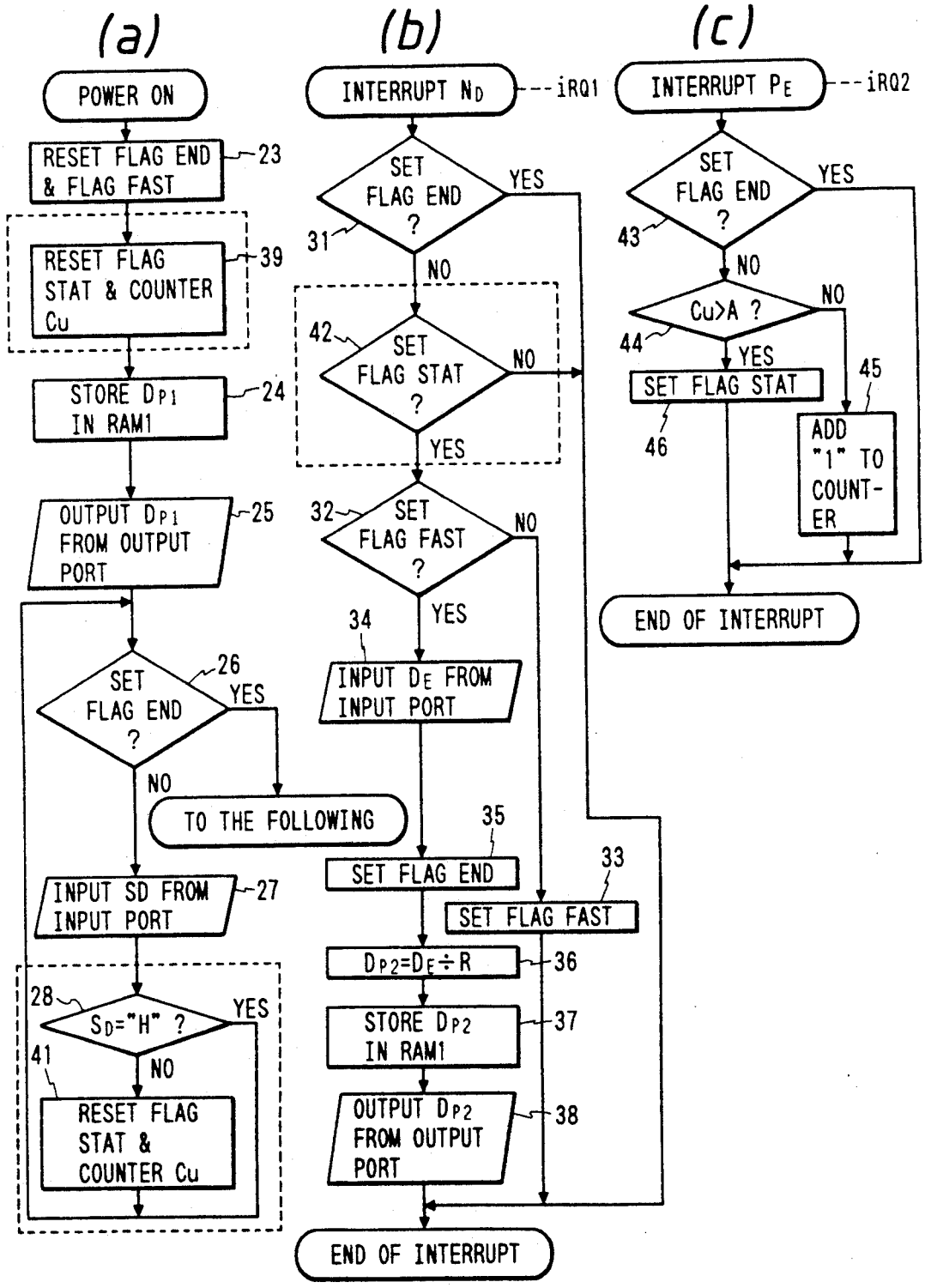
FIG. 1 is a flow chart for a description of a first embodiment of this invention.
Figure 9:
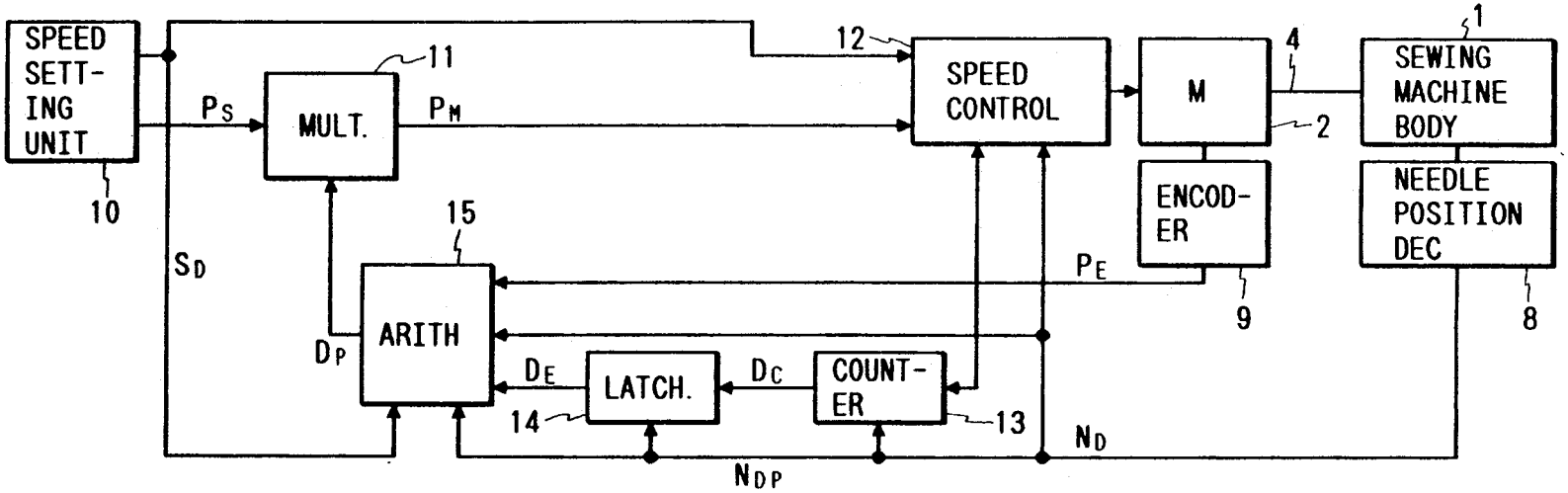
FIG. 9 PRIOR ART
FIG. 9 is a block diagram showing the arrangement of a sewing machine control apparatus concerning a prior art to the invention and embodiments of the invention.
Figure 10:
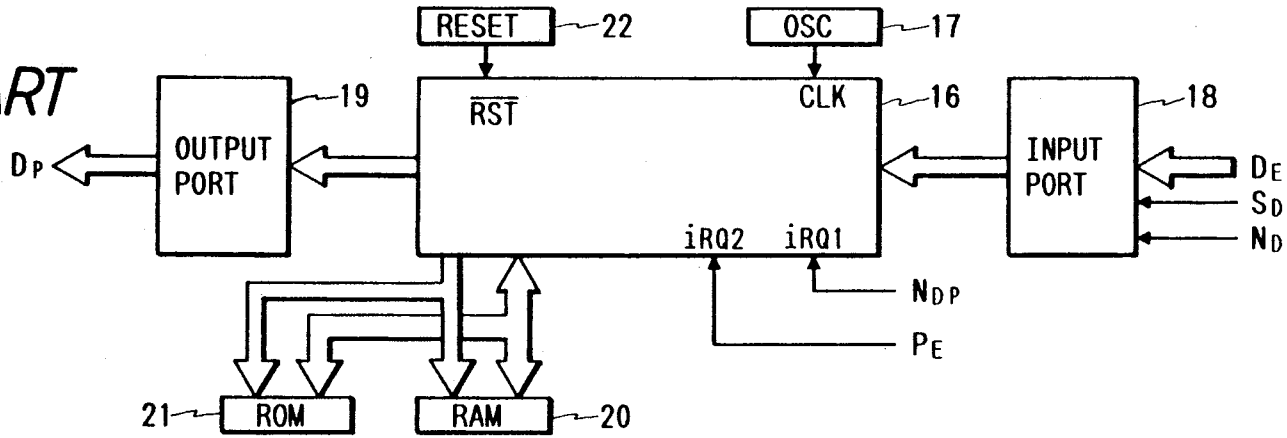
FIG. 10 PRIOR ART

FIG. 1 is a flow chart for a description of a first embodiment of the invention. The arrangement of hardware in the first embodiment is similar to that in the prior art described with reference to FIGS. 9 and 10. FIG. 1 (the first embodiment) is different from FIG. 11 (the above-described prior art) in the parts surrounded by the broken line in the part (a) of FIG. 1, the part encircled by the broken line in the part (b) of FIG. 1, and an interrupt indicated in the part (c) of FIG. 1.

In Step 39 initial setting operations are carried out. In Step 28, it is determined whether the start instruction signal $S_D$ received through the input port is at "L" level or at "H" level. When it is determined that the start instruction signal is at "L" level, then in Step 41 a flag STAT and a counter Cu are reset. When it is determined that the start instruction signal $S_D$ is at "H" level, then Step 26 is effected again.

The flag START is to indicate whether or not the rotation transfer ratio operation can be performed. The counter Cu is to indicate how many times the output signal $P_E$ of the encoder 9 is detected.

In Step 42, it is determined from the flag STAT whether or not the rotation transfer ratio operation should be carried out. If in Step 46 the flat STAT is set, the rotation transfer ratio operation is performed; and if not set, the operation is not carried out.

The interrupt processing routine shown in the part (c) of FIG. 1 is such that, when the output signal $P_E$ of the encoder 9 is detected, the main routine is switched over to the interrupt processing routine, and after the latter has been accomplished, the previous Step is effected again. In Step 43, it is determined from the flag END whether or not the rotation transfer ratio operation has been accomplished. If it is determined that the rotation transfer ratio operation has been accomplished, the interrupt processing operation is ended; and if not accomplished yet, Step 44 is effected.

In Steps 44 and 45, the amount of movement made after the start of the motor is detected by counting the signal $P_E$.

Figure 12:
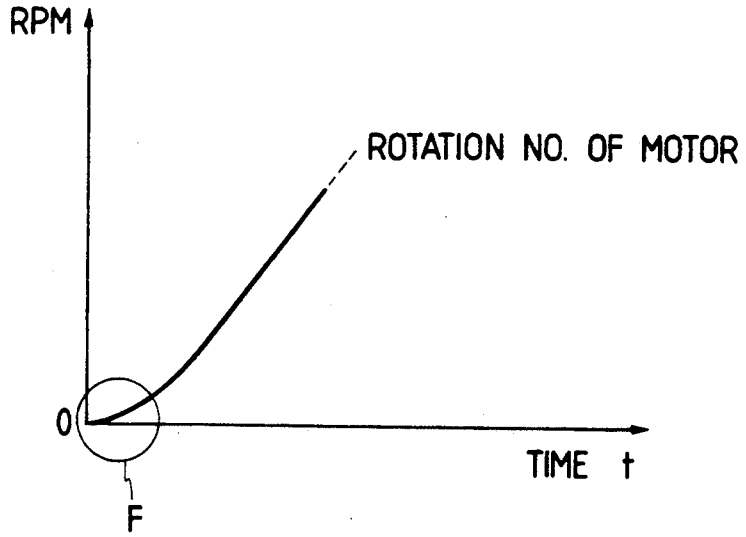
FIG. 12 is a graphical representation indicating motor speed with time during start operation.
Figure 13:
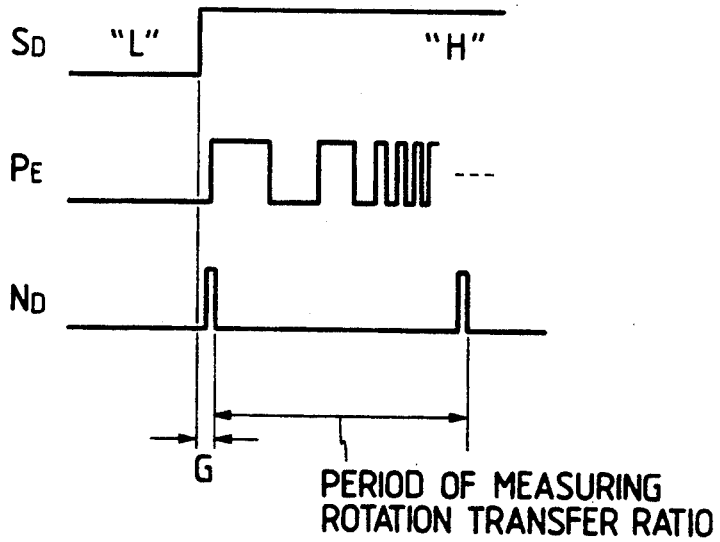
FIG. 13 is a time chart for a description of the operation of the sewing machine control apparatus.

In general, as shown in FIG. 12, the slip is liable to occur at the start of motor, particularly at an initial increasing of the rotation speed of the motor. Accordingly, the amount of movement thus detected is compared with a value A representing the amount of movement with which the slip may be removed. As a result of the comparison, when the amount of movement does not exceed the value A, since there is a possibility that the slip may still remain, the rotation transfer ratio operation is not allowed to start.

In Step 44, the number of times of detection of the output signal $P_E$ of the encoder is compared with the set value A. When the number of times of detection is smaller than the set value A, then Step 45 is effected in which one (1) is added to the count value of the counter Cu, and the interrupt processing operation is ended. When the number of times of detection is larger than the set value A, then in Step 46 the flag STAT is set, and the interrupt processing operation is ended.

As is apparent from the above description, the first embodiment is so designed that if the number of times of detection of the output signal $P_E$ of the encoder 9 is smaller than the set value A, the rotation transfer ratio operation is not started. Hence, employing as the set value A the value which is larger than the value of $P_E$ counted from the start until the state in which no slip occurs is obtained can inhibit the rotation transfer ratio operation in the situation that a slip may occur.

In the case where "the output signal $P_E$ of the encoder 9 cannot be detected because of the breaking of wire", the interrupt processing operation shown in the part (c) of FIG. 1 is not carried out, and therefore the flag STAT is not set, and accordingly the rotation transfer ratio operation is not performed. That is, in the circumstance that an error may occur with the rotation transfer ratio operation, the operation is inhibited. In the above-described embodiment, it is determined from the number of times of detection of the signal $P_E$ of the encoder 9; however, in the case where the needle position detector 8 outputs a plurality of needle position signals $N_D$ at equal angular intervals during each rotation, the number of needle position signals $N_D$ may be employed to determine whether or not the rotation transfer ratio operation should be performed.

Figure 2:
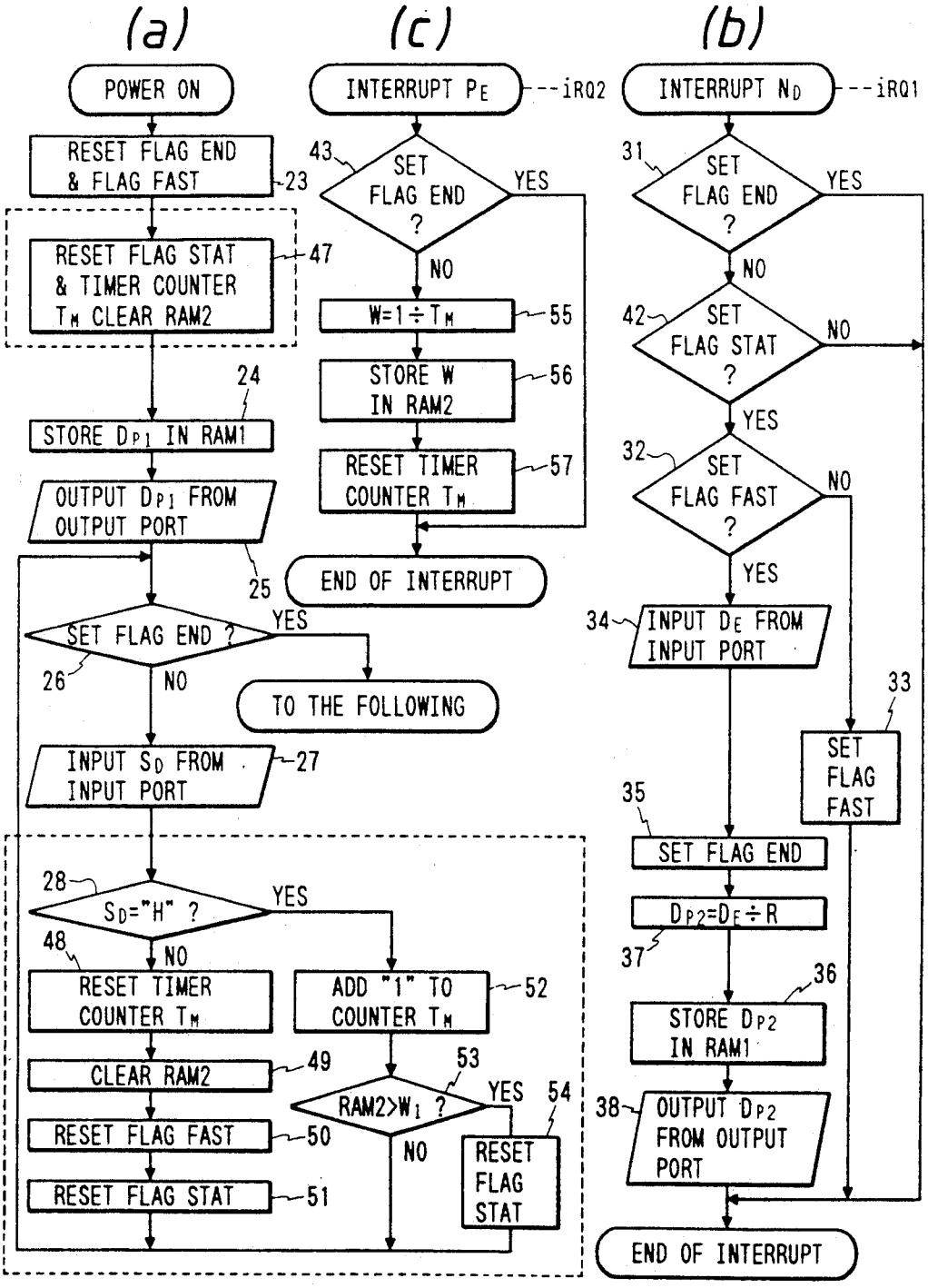
FIG. 2 is a flow chart for a description of a second embodiment of the invention.

FIG. 2 is a flow chart for a description of a second embodiment of the invention. The arrangement of hardware in the second embodiment is similar to that in the prior art described with reference to FIGS. 9 and 10.

FIG. 2 (the second embodiment) is different from FIG. 1 (the first embodiment) in the parts encircled by the broken line in the part (a) of FIG. 2 and an interrupt processing operation indicated in the part (c) of FIG. 2. In Step 47, initial setting operations are carried out. In Step 28, it is determined whether the start instruction signal $S_D$ received through the input port is at "L" level or at "H" level. If it is determined that the signal is at "L" level, then the operations in Steps 48, 49, 50 and 51 are carried out, and then Step 26 is effected again. If the signal is at "H", then Step 52 is effected, so that one (1) is added to the count value of a timer counter $T_M$. The timer $T_M$ is reset in Step 57 when the output signal $P_E$ of the encoder 9 is detected, and therefore it is used to count the time from the detection of one signal $P_E$ until the detection of the next signal $P_E$.

In Step 55, a number of revolutions w is obtained by operating the inverse of the count value of the timer counter $T_M$, and in Step 56 the number of revolutions w thus obtained is stored in a RAM2. In step 53, the content of the RAM 2 is compared with a set value $w_1$ provided for the comparison of speed. When the content of the RAM2 is larger than the set value $w_1$, then in Step 54 a flag STAT is set. Hence, if the flag STAT has been set in Step 42, the rotation transfer ratio operation in Steps 32, . . . can be carried out; and if not, the rotation transfer ratio operation is not carried out.

In the second embodiment thus designed, the rotation transfer ratio operation is started only when the number of revolutions of the motor shaft is higher than the set value $w_1$.

As is apparent from FIG. 12 showing the number of revolution s per minute (rpm) of the motor during start time, the slip occurs generally when the speed of the motor is low as in the start time. Therefore, setting the value $W_1$ to a value with which no slip occurs can prevent the rotation transfer ratio operation from being performed in the circumference that a slip occurs.

Thus, the operation is carried out under the condition that it is predicted that no slip occurs, which can eliminate the rotation transfer ratio operation error. In the second embodiment, the number of revolutions per minute of the motor shaft is obtained as shown in the part (b) of FIG. 2; however, if the number of revolution per minute can be obtained by a different method, then it may be subjected to comparison in Step 53 to obtain the same effect Furthermore, the same effect can be obtained by performing the rotation transfer ratio operation according to the number of revolutions per minute of the sewing machine spindle instead of the number of revolutions per minute of the motor shaft.

In the above-described embodiment, the encoder 9 is employed as speed detecting means. However, the technical concept of the invention can be equally applied to the case where a tachometer generator is employed instead of the encoder 9.

Figure 3:
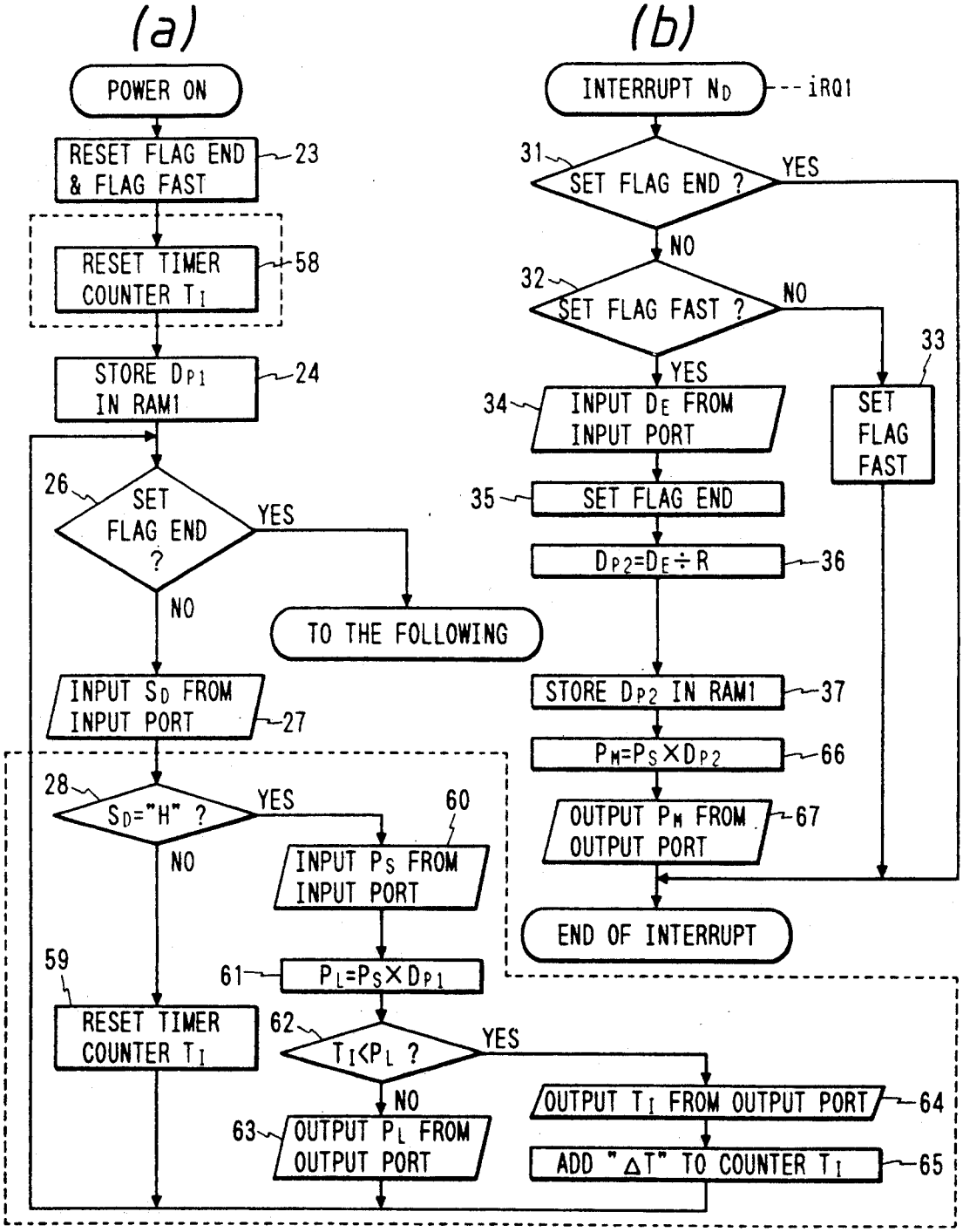
FIG. 3 is a flow chart for a description of a third embodiment of the invention.
Figure 4:
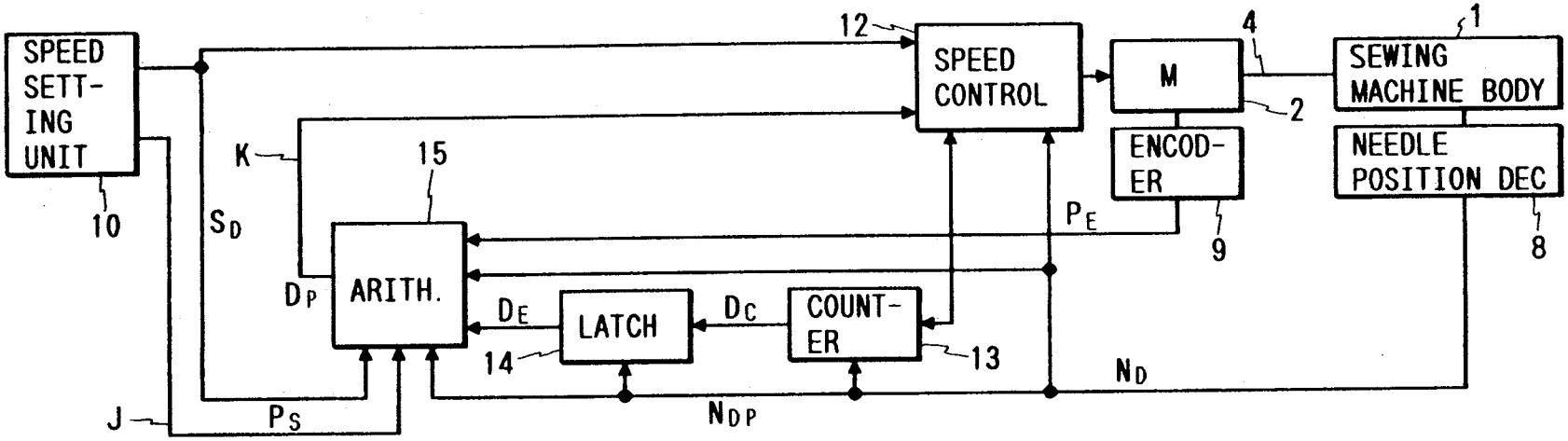
FIG. 4 is a block diagram of a sewing machine control apparatus, the third embodiment of the invention.
Figure 5:
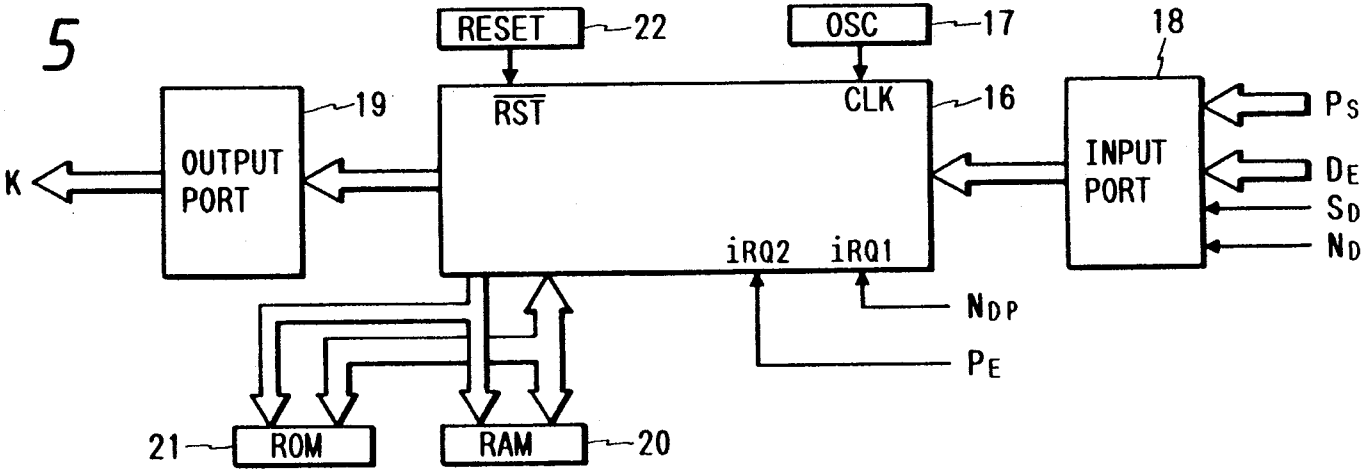
FIG. 5 is a block diagram showing the arrangement of an arithmetic unit shown in FIG. 4.

FIG. 3 is a flow chart for a description of a third embodiment of the invention. The arrangement of hardware in the third embodiment is as shown in FIGS. 4 and 5. The third embodiment shown in FIGS. 4 and 5 is different from the prior art shown in FIGS. 9 and 10 in that the multiplier 11 is eliminated, the speed instruction signal $P_S$ is applied to the arithmetic circuit 15 (as indicated at J in FIG. 4), and the speed setting signal $P_M$ is provided by the arithmetic circuit 15.

Figure 6:
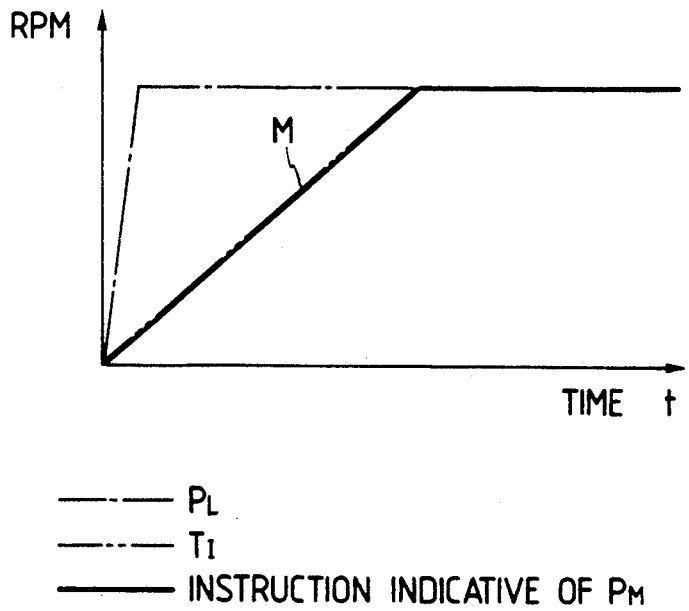
FIG. 6 is a graphical representation for a description of the output operation of the third embodiment.
Figure 8:
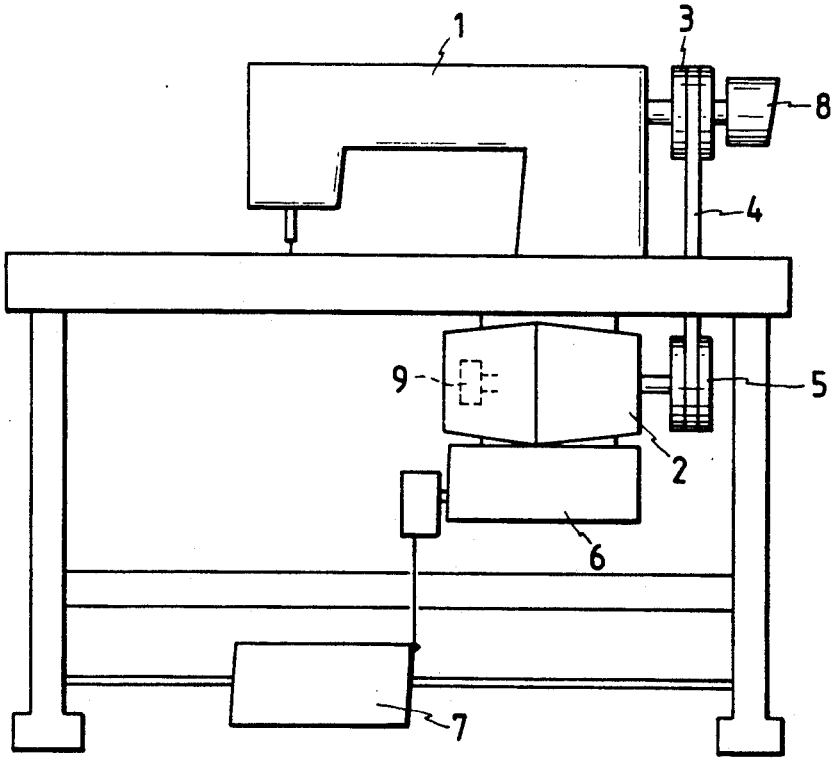
FIG. 8 PRIOR ART
FIG. 8 is a front view of a sewing machine to which the technical concept of the invention is applied.
Figure 11:
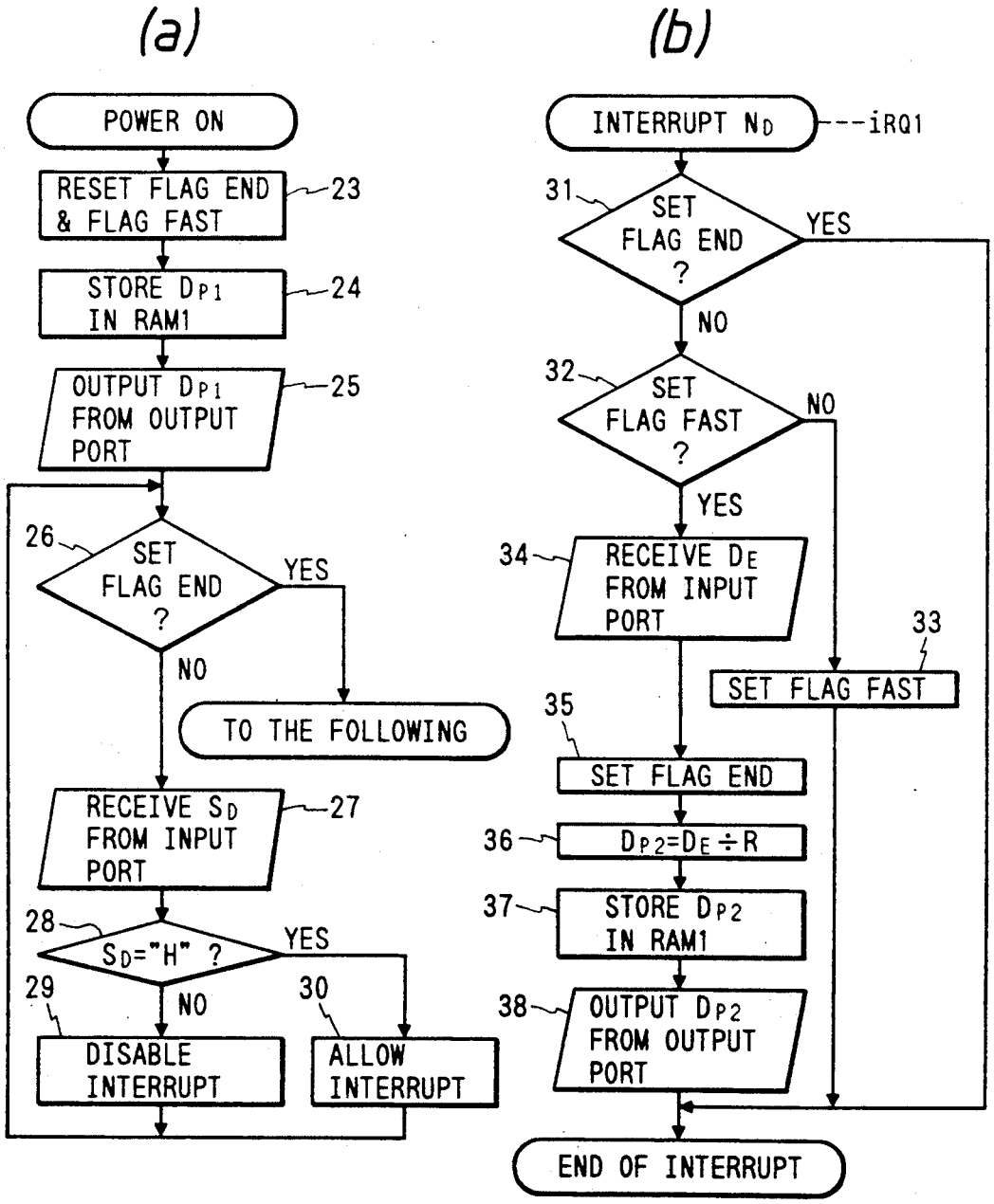
FIG. 11 PRIOR ART
FIG. 11 is a block diagram showing the arrangement of an arithmetic circuit in FIG. 10.

The flow chart of FIG. 11 used for a description of the prior art is different from FIG. 3 in the parts encircled by the broken lines in the part (a) of FIG. 3 and in the elimination of Step 25 from the part (a) of FIG. 3. In Step 58, initial setting operations are carried out. In Step 28, it is determined whether the start instruction signal $S_P$ received through the input port is at "L" level or at "H" level. If it is determined that the start instruction signal is at "L" level, then the operation in Step 59 is carried out, and Step 26 is effected again. If it is at "H" level, then Step 60 is effected to receive the speed instruction signal $P_S$, and in Step 61 a speed set value $P_L$ is operated ($D_{P1}$ being the initial pulley ratio). Thereafter, in Step 62, the speed set value $P_L$ s compared to the count value of a timer counter $T_I$. The timer counter $T_I$ is to provide a false speed set value. The count value of the timer counter increases in proportion to the lapse of time from the time instant that the start instruction signal $S_D$ is raised to "H" level, as shown in FIG. 6 (it should be noted that the count value of the timer counter $T_I$ will not become larger than the speed set value $P_L$). In Step 62, the count value of the timer counter $T_I$ is compared with the speed set value $P_L$, and Step 63 or Step 64 is effected so that the smaller of these two data is outputted, as a speed set instruction $P_M$, through the output port.

The part (b) of FIG. 3 shows an interruption processing operation carried out when the needle position signal $N_P$ is detected. In Step 34 and the following Steps, the rotation transfer ratio operation is carried out. The rotation transfer ratio obtained in Step 36 is stored in the RAM1 in Step 37. After the rotation transfer ratio operation, the product of the rotation transfer ratio and the speed instruction value $P_S$ is outputted as a rotation set instruction $P_M$.

That is, in Step 64, acceleration is effected with the speed set value $P_L$ being larger than the speed/time (acceleration) set by the timer counter $T_I$, so that $T_I$ is outputted thereby to prevent the acceleration which is higher than the speed/time set by the timer counter $T_I$.

Before Step 66, the operation is not accomplished yet, and therefore $P_M$ is outputted as an instruction value $P_L$ or $T_I$ with which no slip occurs. However, after the operation; i.e., after Step 66 it is unnecessary to prevent the slip, and therefore the result of operation $D_{P2}$ is used to provide an output $P_M$. The term "before operation" is intended to mean all the Steps except Step 67, and the term "after operation", the case where "next operation" branching from Step 26 is effected. The operation itself is carried out in Steps 34 through 37 and Step 66.

As is apparent from the above description, before the operation the rotation transfer ratio is not determined yet, and therefore a temporary rotation transfer ratio $D_{P1}$ is set for instance to 1:1 ($D_{P1}=1$), and it is multiplied by a speed instruction value $P_S$ which is provided by the operator's depressing the pedal. The resultant product is provided as a temporary speed instruction value $P_L$. The value $P_L$ and the value $T_I$ is subjected to comparison, to output one of these values. In the third embodiment thus designed, even if the speed instruction signal $P_S$ is one requiring an extremely abrupt speed change (or a signal in variation), a speed instruction will not be outputted which is steeper than the gradient M in FIG. 6.

A slip is liable to occur with the abrupt change of speed. However, according to the invention, the occurrence of slips is prevented, which eliminates the rotation transfer ratio error.

Figure 7:
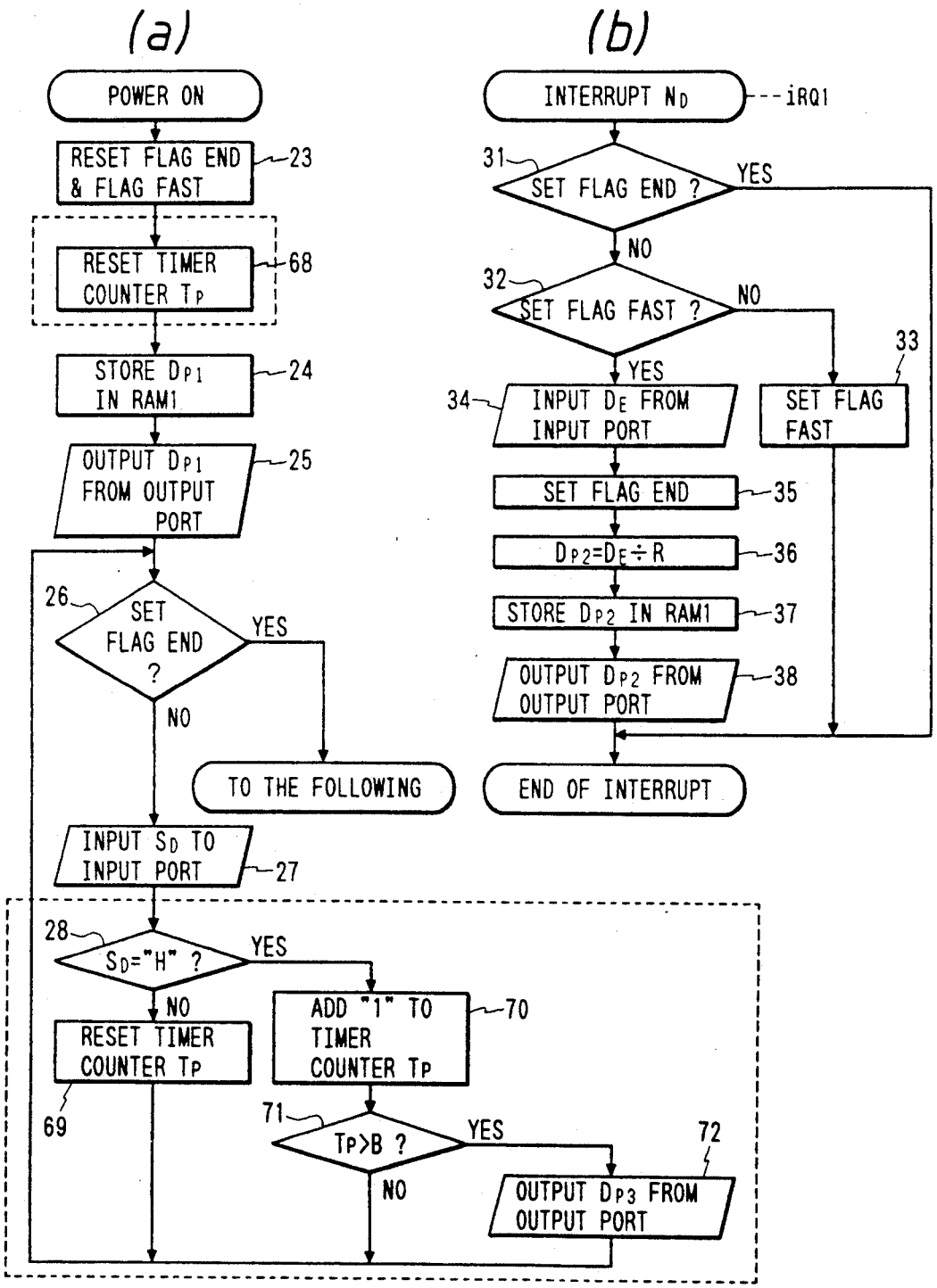
FIG. 7 is a flow chart for a description of a fourth embodiment of the invention.

FIG. 7 is a flow chart for a description of a fourth embodiment of the invention. The arrangement of hardware in the fourth embodiment is similar to that in the prior art described with reference to FIGS. 9 and 10.

The flow chart of FIG. 7 (the fourth embodiment) is different from the flow chart of FIG. 11 (the prior art) in the parts surround by the broken lines in the part (a) of FIG. 7. In Step 68, initial setting operations are carried out. In Step 28, it is determined whether the start instruction signal $S_D$ received through the input port is at "L" level or at "H" level. If it is at "L" level, the operation in Step 69 is carried out, and Step 26 is effected again. If it is at "H" level, Step 70 is effected to add one (1) to the content of a timer counter $T_P$. The timer counter $T_P$ is one which, when the start instruction signal $S_D$ is raised to "H" level, start its time counting operation. In Step 71, the content of the timer counter $T_P$ is subjected to a predetermined set value B. When the content of the timer counter $T_P$ is smaller than the set value B, then Step 26 is effected again; and if the former is larger than the latter, then Step 72 is effected to output a rotation transfer ratio $D_{P3}$, and Step 26 is effected again. The rotation transfer ratio $D_{P3}$ is provided when an abnormal condition occurs. Since the abnormal condition has occurred, it is desirable to decrease the speed of the sewing machine for safety, and therefore $D_{P3}$ is smaller than $d_{P1}$.

In the case of an operation error, being distinguished from other errors, the sewing machine is not stopped.

In the above-described embodiment, performing the operation corresponding to the occurrence of an error for a period of time longer than predicted means the fact that for instance the interruption of a signal $N_{BP}$ is not caused, and the route of "NO" branching from Step 26 is repeatedly effected.

In the fourth embodiment thus designed, when, with the rotation transfer ratio $D_{P3}$ set to half ($\frac{1}{2}$) of the rotation transfer ratio $D_{P1}$, the speed instruction signal $P_s$ is maintained unchanged, then speed of the motor is reduced to half ($\frac{1}{2}$).

In the invention, when an error occurs with the rotation transfer ratio operation, the motor shaft speed instruction may increase the speed. Therefore, security can be established by decreasing the motor operating speed to half. Furthermore, with the amount of depression of the pedal maintained unchanged, the speed of the motor is greatly changed, which informs the operator of the fact that an error has occurred with the rotation transfer ratio operation.

In the above-described embodiment, when the needle position signal $N_D$ cannot be detected for instance because of the breaking of wire; that is, the count value of the timer counter $T_P$ exceeds the set value B, it is determined that an error has occurred with the rotation transfer ratio operation. However, the same effect can be obtained by determining the occurrence of an error with the rotation transfer ratio operation when other data, for instance the value $D_{P2}$, is abnormally larger or smaller.

In the above-described embodiment, the rotation transfer ratio $D_{P3}$ is set to half ($\frac{1}{2}$) of the rotation transfer ratio $D_{P1}$; however, it may set to other than $\frac{1}{2}$, if the former is smaller than the latter.

As was described above, in the invention, when the output signal of the rotation detecting means cannot be detected for instance because of poor contact, the rotation transfer ratio operation is inhibited, and when the signal is detected later, the rotation transfer ratio operation is carried out. This will positively eliminate the occurrence of an error with the rotation transfer ratio operation.

Furthermore, since the rotation transfer ratio operation is carried out under the stable condition that no slip occurs with the motor pulley, endless belt and sewing machine body pulley, the difficulty can be eliminated that errors occur with the rotation transfer ratio operation.

In the case where the speed instruction requires an abrupt speed change (the speed instruction is considerably large in the gradient of change), the gradient of change of the speed instruction is decreased, so that the occurrence of slips is prevented, and accordingly the rotation transfer ratio operation is carried out with high accuracy.

When an error occurs with the rotation transfer ratio operation, the motor shaft speed instruction tends to increase the speed; that is, the speed may be increased. Therefore, decreasing the speed can enhance security for the operator.

According to the invention, the difficulty that errors occurs with the rotation transfer ratio operation is eliminated. Hence, the sewing machine control apparatus according to the invention has a merit that, when control is so made that, no matter what ratio is established between the motor pulley and the sewing machine body pulley, the relation of the sewing machine speed with respect to the amount of depression of the pedal be constant, the occurrence of an error is prevented, and the speed is not increased to an abnormally high value.

What is claimed is:

1. A sewing machine control apparatus for controlling the speed of a sewing machine which is rotated by an electric motor comprising:

speed detecting means for detecting a speed of said electric motor;

needle position detecting means for detecting a needle position of said sewing machine to provide a needle position detection signal;

arithmetic means for performing an arithmetic operation to obtain a rotation transfer ratio in accordance with said needle position detection signal and an output signal of said speed detecting means;

means for controlling a start time of the arithmetic operation of said arithmetic means; and a control section for controlling the speed of said electric motor according to a result of the arithmetic operation of said arithmetic means.

2. A sewing machine control apparatus as claimed in claim 1, wherein said means for controlling the start time of the arithmetic operation of said arithmetic means inhibits the arithmetic operation of said arithmetic means for a predetermined period of time immediately after said electric motor is started.

3. A sewing machine control apparatus for controlling the speed of a sewing machine which is rotated by an electric motor comprising:

speed detecting means for detecting a speed of said electric motor;

needle position detecting means for detecting a needle position of said sewing machine to provide a needle position detection signal;

arithmetic means for performing an arithmetic operation to obtain a rotation transfer ratio in accordance with said needle position detection signal and an output signal of said speed detecting means;

means for detecting, before the rotation transfer ratio operation and during a rotation transfer ratio measurement, a rate of increase with time of a speed instruction for accelerating said electric motor;

decreasing means for decreasing the rate of increase of the speed instruction after said rotation transfer ratio operation; and a control section for controlling the speed of said electric motor according to a result of the arithmetic operation of said arithmetic means.

4. A sewing machine control apparatus as claimed in claim 3 wherein said decreasing means sets the rate of increase to a predetermined value.

5. A sewing machine control apparatus for controlling the speed of a sewing machine which is rotated by an electric motor comprising:

speed detecting means for detecting a speed of said electric motor;

needle position detecting means for detecting a needle position of said sewing machine to provide a needle position detection signal;

arithmetic means for performing an arithmetic operation to obtain a rotation transfer ratio in accordance with said needle position detection signal and an output signal of said speed detecting means;

decreasing means for decreasing, when an error occurs with a rotation transfer ratio operation, said rotation transfer ratio such that the rotation transfer ratio is smaller than that rotation transfer ratio provided before said error occurred; and a control section for controlling the speed of said electric motor according to a motor speed instruction which is obtained by multiplying a sewing machine speed by said rotation transfer ratio.

6. A sewing machine control apparatus for controlling the speed of a sewing machine which is rotated by an electric motor comprising:

speed detecting means for detecting a speed of said electric motor;

needle position means for detecting a needle position of said sewing machine to provide a needle position detection signal;

arithmetic means for obtaining a rotation transfer ratio according to said needle position detection signal and an output signal of said speed detecting means;

means for setting said rotation transfer ratio to a predetermined value upon detecting that data, provided for said arithmetic means, is out of a range predicted and preset for said arithmetic means; and a control section for controlling the speed of said electric motor according to a motor speed instruction which is obtained by multiplying a sewing machine speed instruction by said rotation transfer ratio.

7. A sewing machine control apparatus as claimed in claim 6 wherein said data represents a measurement period of time for the rotation transfer ratio.

8. A sewing machine control apparatus as claimed in claim 6 wherein said data is a result of operation.

9. A sewing machine control apparatus as claimed in claim 6 wherein said set predetermined value causes a speed of said motor to decrease to a motor speed which is substantially less than a motor speed according to a motor speed instruction which is obtained by multiplying said sewing machine speed instruction by an initial pulley ratio.

10. A sewing machine control method comprising:

a step of detecting a speed of an electric motor and a needle position of a sewing machine to output detection signals thereof;

a step of operating a rotation transfer ratio by using said detection signals;

an arithmetic operation starting step of starting the arithmetic operation of said rotation transfer ratio in a predicted range which is so predicted that, in said range, the occurrence of slip between an endless belt and at least one of a pulley of said sewing machine body and a pulley of said electric motor is less in probability.

11. A sewing machine control method as claimed in claim 10 wherein said arithmetic operation starting step, when one of the speed of said electric motor and the amount of movement of the needle position of said sewing machine reaches a predetermined value, the arithmetic operation of said rotation transfer ratio is started.

12. A sewing machine control method as claimed in claim 10 wherein said predicted range excludes a predetermined period of time at the start of said electric motor.

13. A sewing machine control method comprising:

a step of detecting a speed of an electric motor and a needle position of a sewing machine body, to output detection signals thereof;

a step of performing the arithmetic operation of a rotation transfer ratio by using said detection signals, and controlling the speed of said electric motor according to an instruction which is provided as a result of said arithmetic operation; and a step of outputting, when said result of the arithmetic operation provides a signal to cause a first speed change, an instruction preset for a second speed change instead of said signal, said first speed change being substantially greater than the second speed change.

14. A sewing machine control method comprising:

a step of detecting a speed of an electric motor and a needle position of a sewing machine, to output detection signals thereof;

a step of performing an arithmetic operation of a rotation transfer ratio by using said detection signals; and a step of controlling said rotation transfer ratio during one of a detection of said signals and a duration of the arithmetic operation, to set a rate of increase with time of the speed of said electric motor to a value which is lower than a predetermined value.

15. A sewing machine control method comprising:

a step of detecting a speed of an electric motor and a needle position of a sewing machine, to output detection signals thereof;

a step of performing an arithmetic operation of a rotation transfer ratio by using said detection signals; and a step of setting said rotation transfer ratio to a predetermined value upon detecting that said arithmetic operation is being performed out of a predicted range.

16. A sewing machine control method comprising:

a step of detecting a speed of an electric motor and a needle position of a sewing machine, to output detection signals thereof;

a step of performing an arithmetic operation of a rotation transfer ratio of the sewing machine by using said detection signals; and a step of setting said rotation transfer ratio to a predetermined constant value upon detecting that a result of said arithmetic operation is out of a predicted range.

* * * * *